United States Patent [19]

Hixson

[11] Patent Number: 4,998,514

[45] Date of Patent: Mar. 12, 1991

[54] SELF-OPERATING LASH-ADJUSTING TAPPET ASSEMBLY

[76] Inventor: William J. Hixson, 4220 NE 90th, Seattle, Wash. 98115

[21] Appl. No.: 424,023

[22] Filed: Oct. 19, 1989

Related U.S. Application Data

[63] Continuation-in-part of Ser. No. 298,250, Jan. 13, 1989, abandoned, which is a continuation of Ser. No. 140,606, Jan. 4, 1988, abandoned.

[51] Int. Cl.[5] ..... F01L 1/22

[52] U.S. Cl. ..... 123/90.53; 123/90.51

[58] Field of Search ..... 123/90.48, 90.49, 90.51, 123/90.52, 90.53, 90.54

[56] References Cited

U.S. PATENT DOCUMENTS

| | | | |
|---|---|---|---|
| 1,733,240 | 10/1929 | Saives | 123/90.53 |
| 2,003,509 | 6/1935 | Jencick | 123/90.53 |
| 2,158,730 | 5/1939 | Russell | 123/90.53 |
| 2,323,965 | 7/1943 | Anglada | 123/90.53 |
| 2,747,559 | 5/1956 | Campbell | 123/90.53 |
| 3,538,895 | 11/1970 | Jensen | 123/90.27 |
| 3,752,130 | 8/1973 | Scheibe | 123/90.52 |
| 3,818,879 | 6/1974 | Line | 123/90.54 |
| 3,989,016 | 11/1976 | Morgan | 123/90.16 |

FOREIGN PATENT DOCUMENTS

| | | | |
|---|---|---|---|
| 2062158 | 5/1981 | United Kingdom | 123/90.53 |

*Primary Examiner*—Charles J. Myhre
*Assistant Examiner*—Weilun Lo
*Attorney, Agent, or Firm*—Ward Brown; Robert W. Beach

[57] ABSTRACT

In an overhead cam internal combustion engine, an adjustable thickness shim assembly is interposed between the end of a valve stem and the underside of a conventional inverted cup follower engaged by the cam shaft. A body component of the shim assembly forms a ramp for a tapered wedge component which is slidable along the ramp to adjust the effective thickness of the shim. The body component has an inclined threaded bore adjacent to the wedge component receiving a screw which when turned advances along the ramp to butt against the wedge component. The body component is formed of a material having a higher coefficient of thermal expansion than the screw such that when the engine is cold the screw is pinched in its bore and will not turn. When the engine is warmed to normal operating temperature, the body component expands to a greater degree than the screw and the screw is free to turn. The bore and screw are positioned such that inertial force exerted on the screw by movement with the valve stem tends to advance the screw toward the edge component so as to adjust the valve clearance automatically.

8 Claims, 3 Drawing Sheets

Fig. 2.
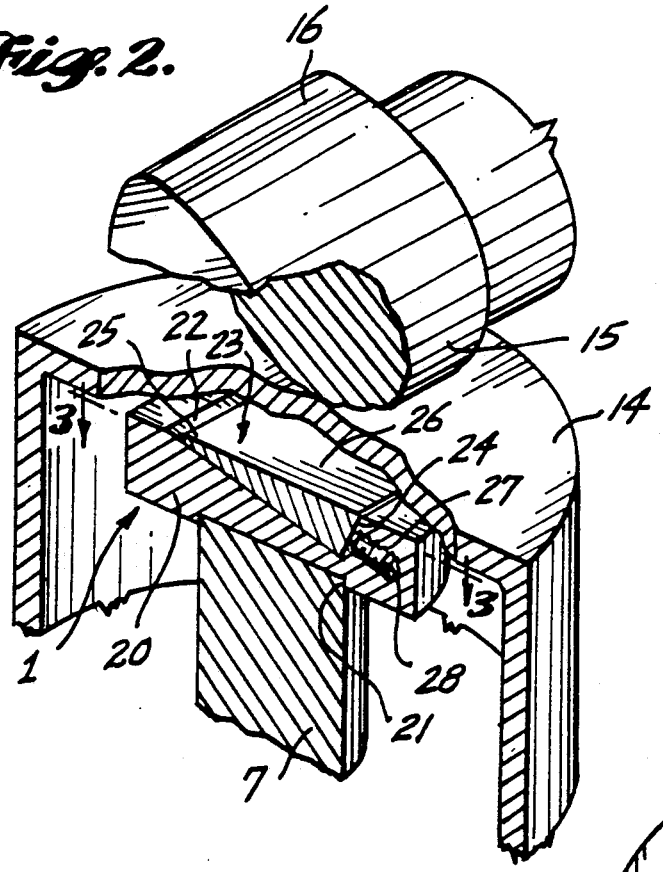
Fig. 3.
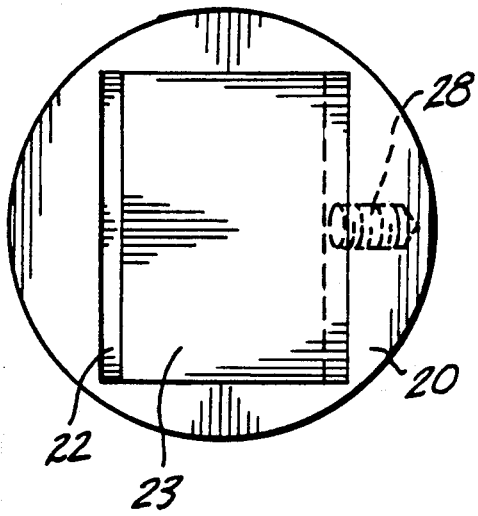
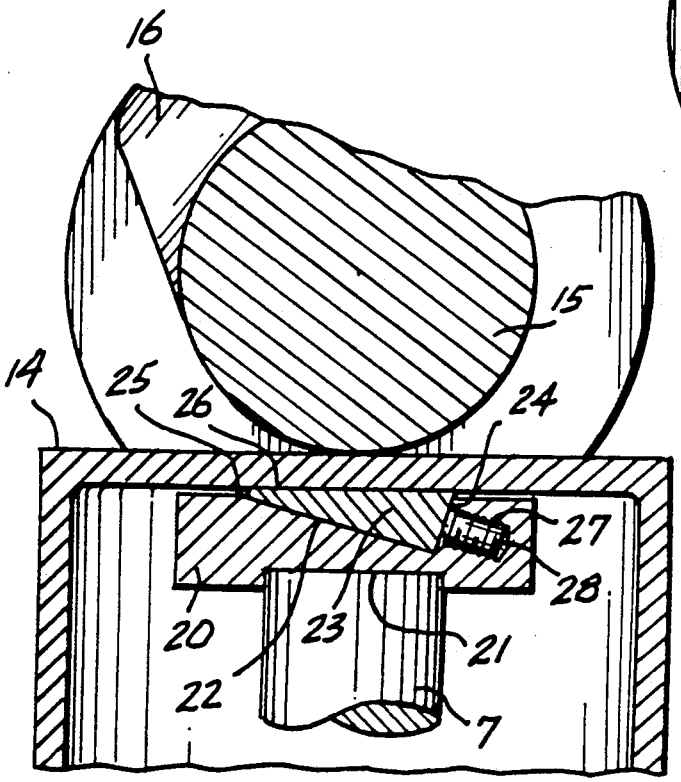
Fig. 4.

Fig. 5.
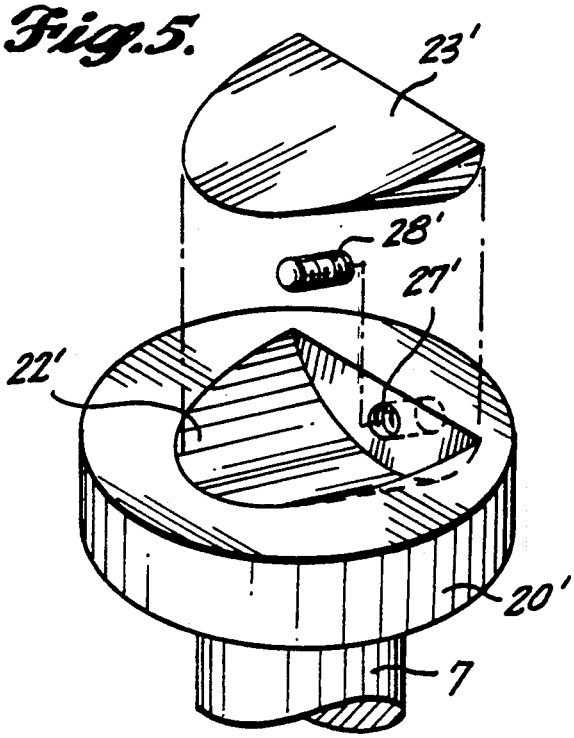
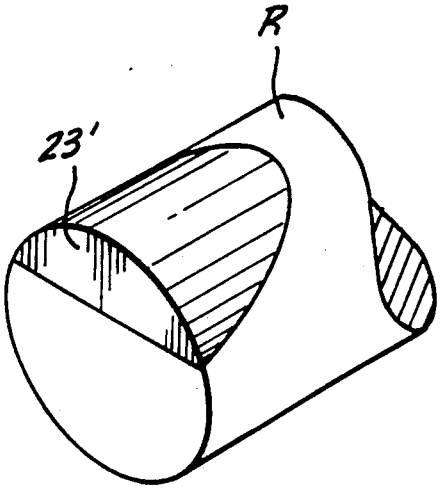
Fig. 6.
Fig. 7.
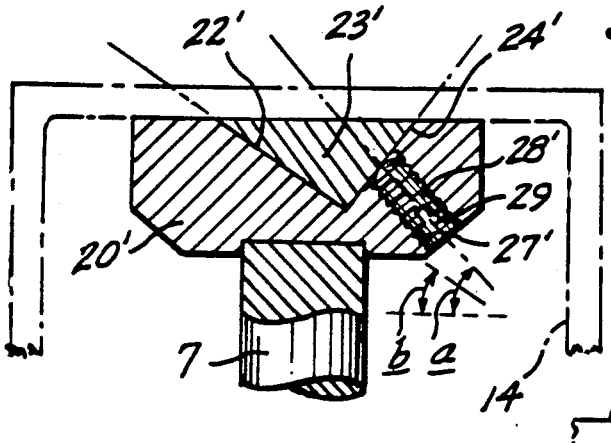
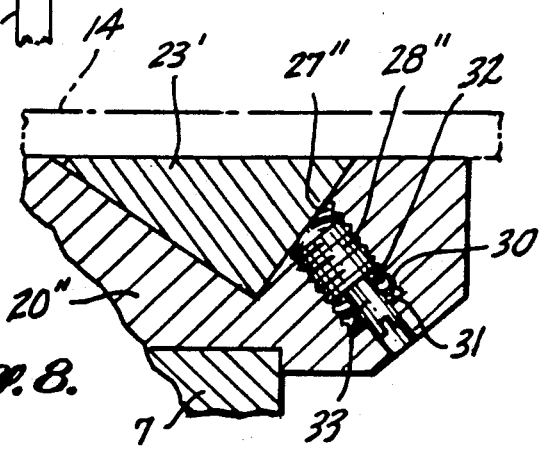
Fig. 8.

SELF-OPERATING LASH-ADJUSTING TAPPET ASSEMBLY

CROSS-REFERENCE

This application is a continuation-in-part of my copending U.S. patent application Ser. No. 298,250, filed Jan. 13, 1989, now abandoned, for An Automatic Valve Shim for Overhead Cam Engines, which is a continuation of my U.S. patent application Ser. No. 140,606 filed Jan. 4, 1988, now abandoned.

BACKGROUND OF THE INVENTION

1. Field of the Invention

The present invention relates to an improved tappet assembly interposed between an overhead cam shaft and the stem of a standard poppet valve of an internal combustion engine. Such assembly is self-operating to eliminate valve lash when the engine is running at its normal operating temperature.

2. Prior Art

The tappet assembly of an overhead cam internal combustion engine commonly includes an inverted cup follower fitted in a cylindrical bore of the cylinder head in line with the upward-projecting stem of a valve. Shims can be used to achieve a desired clearance between the top end of the valve stem and the underside of the cup. The top of the cup is engaged by a lobe of the cam shaft. Ideally, the clearance is set and periodically adjusted such that valve lash is eliminated, i.e., the clearance is zero, when the engine reaches its normal operating temperature. It can be time-consuming, painstaking work to set or adjust the clearance by use of shims of different thicknesses.

More complicated tappet assemblies use screws to move wedgelike shims or to compress elastomeric shims, such as the assemblies disclosed in Jensen U.S. Pat. No. 3,538,895, issued Nov. 10, 1970, Line U.S. Pat. No. 3,818,879, issued June 25, 1974, and Morgan U.S. Pat. No. 3,989,016, issued Nov. 2, 1976. Still, the screws must be turned manually to adjust the valve clearance. Achieving the ideal clearance requires partial disassembly of the engine and the experience and technique of a skilled mechanic.

Representative tappet assemblies intended to be self-adjusting are shown in Saives U.S. Pat. No. 1,733,240, issued Oct. 29, 1929, and Campbell U.S. Pat. No. 2,747,559, issued May 29, 1956.

SUMMARY OF THE INVENTION

The principal object of the present invention is to provide a novel tappet assembly for the valve train of an internal combustion engine having an overhead cam shaft which assembly is effective to set the valve clearance (lash) at zero at normal operating temperatures without manual adjustment after initial installation of such assembly It also is an object to provide such a tappet assembly in a form requiring minimal modification of the engine design so that such assembly may be used for retrofit as well as new engine construction A further object is to provide such an assembly which is of compact and simple design, having only a few cooperating moving parts, and of sturdy reliable construction so that the assembly can be reused following repair work such as a valve grind or camshaft replacement.

In the preferred embodiment of the present invention, the foregoing object is accomplished by providing a tappet assembly including a substantially conventional inverted cup follower interposed between the overhead cam shaft and the upward-projecting valve stem, and an adjustable thickness shim assembly between the underside of the cup follower and the top end of such stem. The adjustable thickness shim assembly includes a body component which preferably is press-fitted on the valve stem for in and out movement with the valve. Such body component forms an inclined ramp for a wedge component which is slidable along the ramp to adjust the effective thickness of the shim. The body component has an inclined threaded bore receiving an actuator screw which is turnable to butt against the wedge.

When cold, the screw is tightly fitted in its bore to prevent rotation and, hence, adjusting movement of the shim wedge. Nevertheless, the screw is formed of a material having a lower coefficient of thermal expansion than the body component in which it is received. As the engine reaches its normal operating temperature, the body component expands, thereby freeing the screw for rotation. The screw is positioned such that its inertia as the valve moves to its uppermost position tends to move the screw outward to move the wedge component and increase the effective thickness of the shim assembly. If the valve clearance is zero at normal operating temperatures, the wedge will be snugly engaged between the follower cup and the ramp of the body component and no outward adjustment will occur. If there is any clearance at normal operating temperatures, the wedge will thrust outward allowing the screw to turn to retain the wedge at the zero clearance position.

When the engine cools, the body component cools and contracts, thereby pinching the screw in its bore to prevent any additional rotation. The length of the valve stem necessarily decreases as it cools such that the valve clearance no longer is zero, but the clearance automatically returns to zero as the engine heats when operated again.

BRIEF DESCRIPTION OF THE DRAWINGS

FIG. 2 is a somewhat diagrammatic, fragmentary, top perspective of the valve train of FIG. 1, with parts broken away.

FIG. 3 is a top plan along line 3—3 of FIG. 2.

FIG. 4 is an enlarged end elevation of the upper portion of the valve train of FIG. 1, with parts broken away.

FIG. 5 is a top perspective of a modified form of self-operating lash-adjusting tappet assembly in accordance with the present invention, and FIG. 6 is a top perspective of a cylindrical rod illustrating the shape of one component of such assembly.

FIG. 7 is a somewhat diagrammatic end elevation of the tappet assembly of FIG. 5, with parts broken away.

FIG. 8 is an enlarged, fragmentary, vertical section of a further modified form of self-operating lash-adjusting tappet assembly in accordance with the present invention.

DETAILED DESCRIPTION

Figure 1:
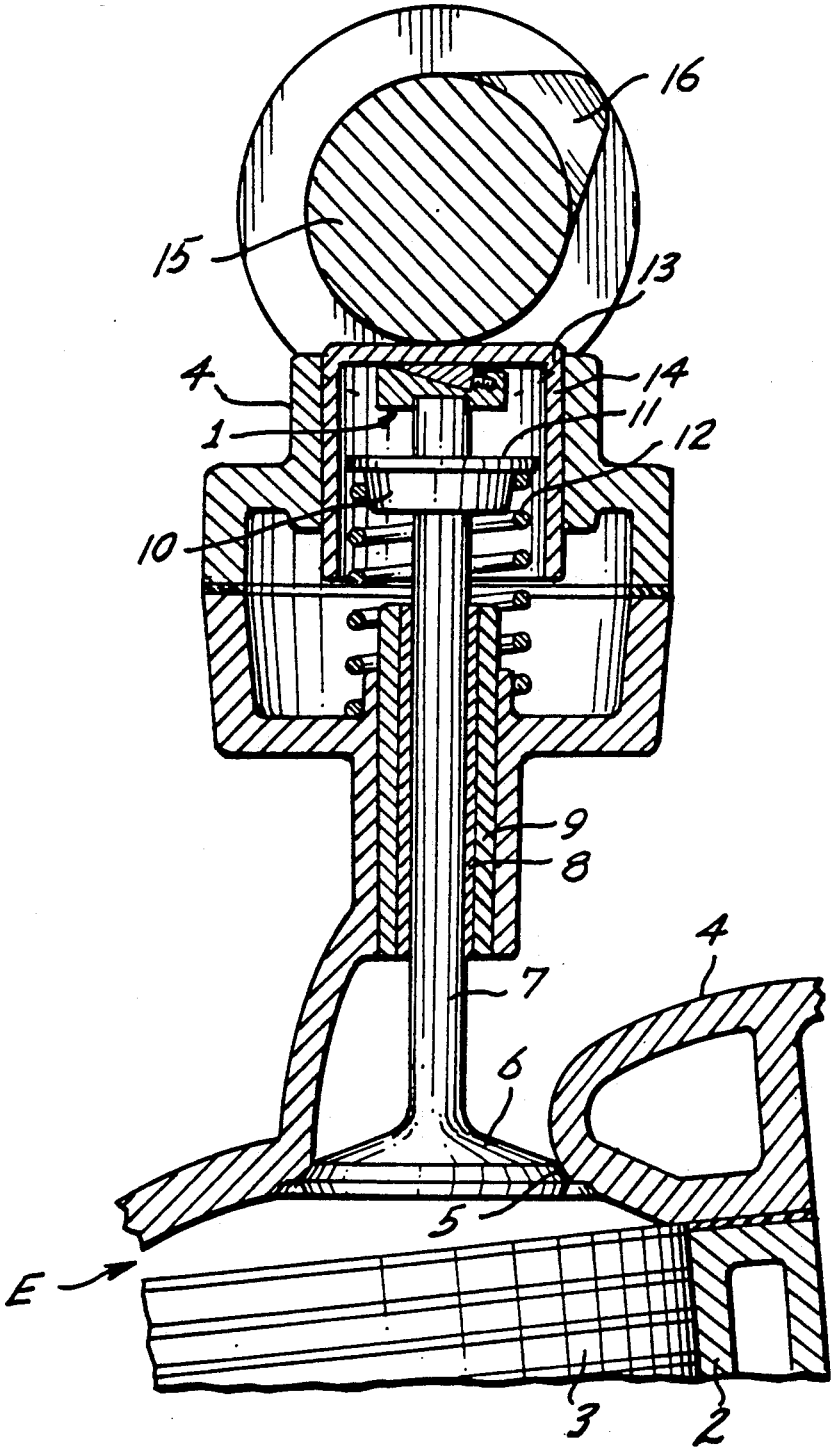
FIG. 1 is a somewhat diagrammatic, fragmentary, vertical section of the valve train and adjacent structure of an overhead cam internal combustion engine having a self-operating lash-adjusting tappet assembly in accordance with the present invention.

The pertinent components of a representative engine E in which a self-operating lash-adjusting tappet assembly 1 in accordance with the present invention is intended to be used are illustrated in FIG. 1. Such engine includes a cylinder 2 receiving the reciprocating piston 3. The top of the cylinder is closed by the cylinder head 4. Head 4 has a frustoconical seat 5 for a poppet valve 6 having an upward-extending stem 7. Stem 7 is slidable in a bushing 8 fitted in the valve guide 9 which, in turn, is fitted in the cylinder head 4.

The upper end portion of the valve stem carries a spring keeper 10 which has an outward-projecting lip 11. A helical compression spring 12 encircles the valve stem and is engaged between the lip 11 of keeper 10 and the interior of the cylinder head for biasing the valve to the closed position indicated in FIG. 1.

The upper portion of the cylinder head has a cylindrical bore 13 slidably receiving the open base portion of an inverted cup follower 14. Such follower is part of the tappet assembly interposed between the top end of the valve stem 7 and the overhead cam shaft 15. As the cam shaft rotates, its lobe 16 engages against the cup follower 14 to force it inward and thereby lift the valve 6 from its seat 5. Ideally, when the engine is running at its normal operating temperature and the valve is in its closed position in which no part of the lobe 16 is engaged against the cup follower, there still is no unfilled clearance between the top end of the valve stem 7 and the periphery of the cam shaft 15. Otherwise, there will be unacceptable wear-inducing, noisy and irritating chattering of the tappet assembly and cup member 14. Nevertheless, it is even more important that the valve 6 be fully closed in order to assure efficient operation of the engine and to avoid accelerated wear or burning of the valve and valve seat.

The novel features of the inventor's self-operating lash-adjusting tappet assembly 1 are best seen in FIGS. 2, 3 and 4 which are drawn on a larger scale than FIG. 1 with parts of the engine deleted. Such assembly 1 includes a composite adjustable thickness shim including a cylindrical body component 20 having a central bottom recess 21 sized so that component 20 can be press-fitted on the upper end of the valve stem 7. The top surface of the body component 20 has a cutout of generally rectangular configuration when viewed in plan (FIG. 3) but of right triangular cross section in vertical section (FIG. 4). The long bottom 22 of such cutout forms an inclined ramp for a complementally shaped wedge component 23 which tapers in thickness from its base end 24 to its tip end 25.

The top (hypotenuse) 26 of the wedge component lies in a plane perpendicular to the axis of the valve stem 7. The body component 20 of the shim assembly has an internally threaded blind bore 27 opening into the top cutout adjacent to the base end 24 of the wedge component 23. Such bore 27 receives an externally threaded adjusting screw 28. In the embodiment shown in FIGS. 2, 3 and 4, the axis of the bore 27 and its screw 28 is parallel to the bottom 22 of the cutout which forms the ramp of the body component.

In accordance with the present invention, the screw 28 can be shrink-fitted in the blind bore 27 of the body component 20. At normal ambient temperatures, the screw is pinched in the bore and will not turn. Nevertheless, the body component 20 is formed of a material having a higher coefficient of thermal expansion than the screw 28. When the internal combustion engine is started, the valve stem 7 is heated and necessarily lengthens due to thermal expansion. Heat is conducted to the body component 20. Such component expands faster than the screw 28 which frees the screw in its bore 27. The screw remains threadedly engaged in the bore but free to turn.

At the time of initial installation, the outer end of the screw 28 should be registered with the outer end of the bore 27 or be spaced inward slightly from it. The wedge component 23 will fit in the deepest part of the top cutout in the body component 20. The overall minimum thickness of the composite shim assembly including the body component 20 and the wedge component 23 is selected such that the shim assembly and cup member 14 do not quite fill the space between the valve stem 7 and cam shaft 15, even when the engine is at normal operating temperature with the valve closed and the associated cam shaft lobe 16 out of engagement with the cup member 14. Consequently, each time the cam shaft lobe moves out of engagement with the top of the cup member, the cup member and wedge component 23 are thrown outward toward the cam shaft. At this stage, since the screw 28 and its bore 27 are inclined outward in the direction of outward thrust of the valve stem 7 at a small acute angle, there is an outward-directed component to the inertial force exerted on the screw 28 which is loosened in the bore 27. Such force causes the screw to turn slightly which, at each stroke, gradually advances the screw outward into engagement with the base 24 of the wedge component 23. As the cam lobe 16 comes back into contact with the cup member 14, the wedge component 23 is forced downward, thereby pinching the screw 28 in its current position Eventually, all clearance between the valve stem 7 and cam shaft 8 is eliminated, i.e., the valve lash is automatically set at zero.

When operation of the internal combustion engine stops and it begins to cool, the body component 20 shrinks faster than the screw 28 and thereby locks the screw in its position even as the valve stem 7 shortens as it cools. Consequently, the effective thickness of the composite shim assembly will remain at the ideal zero clearance or lash condition when the engine is started again.

The modified embodiment shown in FIGS. 5 and 7 includes a body component 20' press-fitted on the end of the valve stem 7 and having a top cutout forming an inclined ramp 22' for a wedge component 23'. In such embodiment, the bore 27' for the adjusting screw 28' is a through bore threaded all the way from the exterior of the body component 20' into the deepest part of its top cutout. The screw 28' can have a slotted outer end 29 for ease of initial adjustment of the screw.

Another modification of the embodiment shown in FIGS. 5 and 7 is the relationship between the angle of the screw 28' and the angle of the ramp 22'. Screw 28' is inclined upward at an angle a greater than 45 degrees, preferably about 50 degrees, from the horizontal so as to have a greater outward-directed component of inertial force applied to it. In addition, the base of the ramp is angled upward and outward at an angle b less than 45 degrees, preferably about 35 degrees, although the base end 24' of the wedge component 23' still is perpendicular to the ramp. The shapes of the wedge component and ramp are changed as best seen in FIG. 5. The ramp and the bottom of the wedge are complementally arcuate, preferably cylindrical about an axis offset from the top of the wedge. The precise shape is best described with reference to FIG. 6. The wedge component 23' can be envisioned as a sliver cut from the end of a cylindrical rod R by a plane oblique to the axis of the rod.

In the embodiment of FIGS. 5 and 7 the screw 28' need not necessarily be shrink-fitted in the body component 20 so long as there is a snug or tight fit. The screw 28' will have a greater tendency to advance upward and outward toward the wedge component 23'. To lessen or eliminate any tendency of the screw to turn in the reverse direction as force is applied against it by the wedge component as the valve stem is forced downward, the base end 24' of the wedge component is not perpendicular to the adjacent end of the screw, and the ramp 22' is not parallel to the axis of the screw, so that the screw is pinched in its bore 27 to a greater degree and will remain in position. The body component 20' still is formed of a material having a greater coefficient of thermal expansion than bore when the engine is cold but is released for advancing movement when the engine warms to its normal operating temperature. Once the screw reaches the zero clearance position, there always is at least some slight force applied against it which prevents additional turning of the screw.

The further modified form illustrated in FIG. 8 is identical to the form shown in FIGS. 5 and 7 with the exception that the bore 27" and screw 28" have been modified to accommodate a small compression spring 30 acting between a shoulder 31 of the bore and a shoulder 32 of the screw. The reduced diameter shank 33 of the screw still is slotted and reachable from the exterior of the body component 20" for initial adjustment. The compression spring 30 increases the tendency of the screw 28" to turn so as to advance outward against the wedge component 23', but must not be of a strength sufficient to overcome the grasping of the screw in the body component when it cools following operation of the engine.

I claim:

1. A self-operating lash-adjusting tappet assembly for an engine having a valve with a stem adjacent to a cam shaft, said tappet assembly comprising a shim assembly interposed between the end of the valve stem and the cam shaft, said shim assembly including a body component forming a ramp and having a threaded bore opening adjacent to said ramp, a wedge component movable along said ramp to adjust the effective thickness of said shim assembly and a screw threadedly received in said bore and positioned such that turning of said screw in one sense moves said screw along said ramp to engage said wedge component and prevent movement of said wedge component in a direction which would decrease the effective thickness of said shim assembly, said body component being formed of a material having a greater coefficient of thermal expansion than the material of said screw, and said screw and body component being constructed and arranged relatively such that at normal ambient temperatures said screw is pinched in said bore so as to prevent rotation thereof whereas at normal operating temperatures of the engine said screw is freed by thermal expansion of said body component for turning in said bore.

2. The assembly defined in claim 1, in which the body component is carried by the valve stem for outward and inward movement therewith, the bore and screw being positioned in the body component such that outward inertial force exerted on the screw by movement with the body component tends to move the screw out of its bore and along the ramp by turning of the screw in the one sense.

3. The assembly defined in claim 1, in which the screw has an axis approximately parallel to the length of the ramp.

4. The assembly defined in claim 1, in which the axis of the screw is inclined outward toward the axis of the valve stem at an angle greater than 45 degrees relative to a plane perpendicular to the axis of the valve stem.

5. The assembly defined in claim 1, in which the wedge component has a flat base end portion facing the bore in the body component and disposed at an acute angle relative to the axis of the screw.

6. The assembly defined in claim 1, in which the ramp is inclined at an angle less than 45 degrees relative to a plane perpendicular to the axis of the valve stem.

7. The assembly defined in claim 1, including spring means biasing the screw outward from its bore toward the wedge component.

8. The assembly defined in claim 1, including an inverted cup follower positioned between the shim assembly and the cam shaft.

* * * * *